United States Patent [19]

Nagata et al.

[11] 4,175,461

[45] Nov. 27, 1979

[54] ELECTROMAGNETIC PICKUP DEVICE

[75] Inventors: Yukio Nagata; Eiji Satoh; Keinosuke Tsuchida, all of Kawasaki, Japan

[73] Assignee: Nippon Columbia Kabushiki Kaisha, Tokyo, Japan

[21] Appl. No.: 826,991

[22] Filed: Aug. 23, 1977

[30] Foreign Application Priority Data

Aug. 25, 1976 [JP] Japan ..... 51-101387
Apr. 30, 1977 [JP] Japan ..... 52-50236

[51] Int. Cl.[2] ..... G10H 3/08
[52] U.S. Cl. ..... 84/1.15; 84/363; 84/402; 84/DIG. 7; 84/DIG. 21
[58] Field of Search ..... 84/1.04, 1.14–1.16, 84/363, 402, DIG. 7, DIG. 21

[56] References Cited

U.S. PATENT DOCUMENTS

| | | | |
|---|---|---|---|
| 3,038,363 | 6/1962 | Miessner | 84/1.14 |
| 3,255,293 | 6/1966 | Walker | 84/1.15 X |
| 4,040,321 | 8/1977 | Lover | 84/1.15 |

*Primary Examiner*—Stanley J. Witkowski
*Attorney, Agent, or Firm*—Hill, Van Santen, Steadman, Chiara & Simpson

[57] ABSTRACT

An electromagnetic pickup device for use in a tone generator of an electronic piano includes a plurality of vibratory reeds and pole pieces of pickups which are so shaped that each reed and pole piece are opposed to each other in a range from the neutral position of the reed to a position within its maximum vibrating amplitude at one side. In output signals of the pickups, the balance of fundamental and odd- and even-numbered harmonics is improved to generate a tone which is close to that of a normal string piano.

5 Claims, 30 Drawing Figures

ELECTROMAGNETIC PICKUP DEVICE

BACKGROUND OF THE INVENTION

1. Field of the Invention

The present invention relates mainly to an electromagnetic pickup device of an electronic piano, and particularly to an electromagnetic pickup device in which pole pieces are made so as to eliminate relative amplitude level difference between odd- and even-numbered higher harmonics.

2. Description of the Prior Art

There has been well known in the art a pickup device of an electronic piano in which vibratory reeds or the like are knocked by hammers to produce mechanical vibration of the reeds which is converted into electric signal by pickups disposed opposite to the reeds for picking the vibration. The construction of this pickup device relating to its electrodes or pole pieces is disclosed in detail in, for example, U.S. Pat. No. 3,038,363.

As the pickup it is generally known to use an electromagnetic pickup or an electrostatic pickup. The construction of a normally used electromagnetic pickup is publicly known as shown in FIG. 1.

In FIG. 1, substantially a U-shaped bed 1 having a large mass is provided with a plurality of cantilever-type vibratory reeds 2 made of a magnetically permeable material having various lengths corresponding to respective musical scales. Opposite to the free end of each reed is provided a pole piece 3 with a proper gap therebetween which is axially inserted into the center of a bobbin 4. The bobbin 4 has bored therein at its upper end a recess 5 in which there is placed a magnet 6 that is magnetized as illustrated. The bobbin 4 is also wound thereabout with a winding 8. An L-shaped metal piece 7 is secured at its one side to the bed 1 with the bobbin 4 being fixed thereto at its other side. With such an arrangement, when one of the reeds 2 is knocked by a hammer 9, the reed 2 is mechanically vibrated due to cross magnetic flux produced from the pole piece 3 so that the winding 8 induces an electric signal which corresponds to the mechanical vibration of the reed. An equivalent circuit having the pole piece arrangement of FIG. 1 is shown in FIG. 2, in which an axial gap between pole piece 3 and reed 2 is taken as l and an axis deviation therebetween as b. Assumed that the reed tip makes a sine-wave vibration with amplitude A and frequency f, magnetic resistance R is shown as $R=K[l^2+(b+A\cos 2\pi ft)^2]$ and magnetic flux $\phi$ is shown as $\phi=F/R$ where F is a magnetomotive force produced by the permanent magnet 6. Taking the number of winding as n, a voltage e induced in the winding 8 is expressed as the following formula (1) based on $e=-n(d\phi/dt)$:

$$e = K\frac{fA(b + A\cos 2\pi ft)\sin 2\pi ft}{[l^2 + (b + A\cos 2\pi ft)^2]^2} \quad (1)$$

where "K" is a proportional constant and "t" is time. As shown in FIG. 3, the signal voltage e is a periodic function of period $T(=1/f)$ so that it exhibits a waveform which is symmetric with respect to a point of T/2. A rising-up period $T_o$ is given as follows:

$$T_o = \frac{T}{2\pi}\cos^{-1}\left(\frac{-b}{A}\right) \quad (2)$$

If the deviation b approaches a zero, $T_o=T/4$ is obtained resulting in a vibrating waveform having a period of T/2 or a frequency of twice the fundamental frequency f. With the electromagnetic pickup having the above construction, the waveform of FIG. 3 is spectrally distributed as shown in FIGS. 4A, 4B and 4C.

In FIGS. 4A to 4C, abscissa represents higher harmonic number or order n and ordinate represents relative amplitude level. FIG. 4A shows a spectral distribution in a case of large deviation b between reed 2 and pole piece 3, FIG. 4B that in a case of small deviation b, and FIG. 4C that in a case of zero deviation, respectively. The sound pitch of an electronic piano is determined by the relation among pitches of the fundamental and higher harmonic components (the order number 1 of harmonic is called as a fundamental tone and those 2, 3 . . . of harmonic (as harmonics) in the spectral distribution of FIGS. 4A to 4C according to the voltage waveform of FIG. 3). The sound pitch is dependent on the fundamental frequency or fundamental tone. Even when the fundamental tone is absent, the difference between harmonics, such as 3f−2f, is heard corresponding to the fundamental tone.

In the prior art electromagnetic pickup device, as shown in FIGS. 4A to 4C, the relative amplitude levels of odd higher harmonic numbers 1, 3, 5 . . . are very small or zero as compared with those of even higher harmonic numbers 2, 4, 6 . . . . As a result, in the cases of FIGS. 4A and 4B a difference tone between even harmonic components (a pitch of higher octave corresponding to double the fundamental frequency, for example, 4f–2f) is heard stronger than a different tone between even and odd harmonic components (a pitch corresponding to the fundamental tone) so that sound pitch becomes quite uncertain. In the case of FIG. 4C, since there is no odd harmonic component, the sound is heard positively as a higher octave. Therefore, in the prior art pickup of FIG. 1 the pitch becomes very uncertain which causes poor selection of tone or improper feeling of sound intervals.

The above-cited U.S. patent has also disclosed an electromagnetic pickup which detects flux variation of only half cycle of the vibratory reed 2 in order to eliminate the above described defect. This construction is shown in FIG. 5 in which elements corresponding to those in FIG. 1 are indicated by the same reference numerals with their repeated description being omitted. In FIG. 5, the pole piece 3 is fixed directly to the bed 1 and wound thereabout with the winding 8, while the vibratory reed 2 is magnetized as illustrated and mounted on the bed 1 in a cantilever type. A voltage waveform derived from the winding 8 by vibrating the reed 2 knocked with a hammer is shown in FIG. 6 and its spectral distribution is shown in FIG. 7. The spectral distribution in this case is reverse to that of FIG. 4B. In other words, the fundamental tone is the highest and even harmonics (2, 4, 6 ...) are relatively low as compared with odd harmonics, but the fundamental tone is always present so that sound pitch will not become uncertain as shown in FIG. 4. Meanwhile, as shown in FIG. 6 no voltage is generated during the half cycles from 0 to T/4 and from 3T/4 to T so that its detection efficiency becomes very small and it is impossible to change the form of spectrum by adjusting the deviation b between pole piece 3 and reed 2 as shown in FIGS. 4A to 4C with the result that only a simple sound is defectively obtained.

The above U.S. patent has also disclosed another type of pickup in which as shown in FIG. 8 the reed 2 and electrode 3 are coupled in a electro-static manner and the mechanical vibration of the reed is detected as the variation of capacitance therebetween. In this case, the electrode 3 is shaped corresponding to the path of reed tip in the case when the reed 2 is knocked by the hammer 9.

The above-described pickup detects an output signal whose waveform is shown in FIG. 9 and whose spectral distribution is shown in FIG. 10, respectively. As will be apparent from this spectral distribution, the uncertainty of sound pitch will not appear similarly as in the case of FIG. 7. However, this electrode construction is of a static pickup type, so that if this pickup was replaced by the electromagnetic pickup as shown in FIG. 1 or FIG. 5, the same spectral distribution as described in FIG. 7 would be obtained resulting in the same defect as the prior art pickup of FIG. 5. The measured result of the above is shown in FIG. 18-H.

SUMMARY OF THE INVENTION

It is an object of this invention to provide an electromagnetic pickup device in which lack of odd harmonics is prevented without lowering detection efficiency, the relative amplitude level difference between odd and even harmonics is eliminated, the uncertainty of sound pitch is improved, and a spectral distribution for providing good tone is obtained.

According to an aspect of the present invention there is provided an electromagnetic pickup device for transducing a mechanical vibration of a vibratory reed to an electric signal which comprises a pole piece opposed to said vibratory reed in the range of vibration from the neutral position to a position not-exceeding the maximum vibrating amplitude of said reed.

The other objects, features and advantages of the present invention will be apparent from the following description taken in conjunction with the accompanying drawings.

DESCRIPTION OF THE PREFERRED EMBODIMENTS

Figure 2:
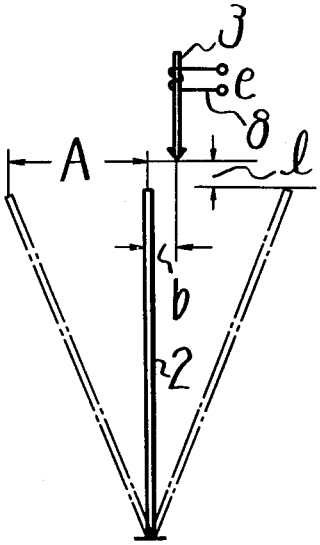
FIG. 2 is a view showing a simplified construction of the pickup shown in FIG. 1.
Figure 11:
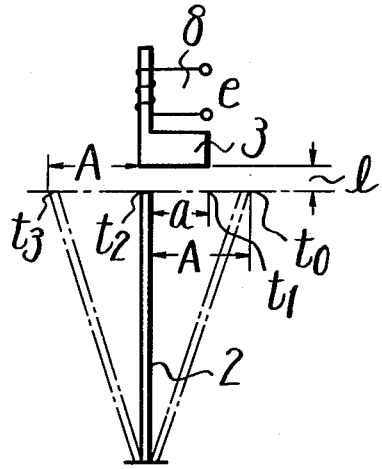
FIG. 11 is a theoretical view showing a pickup device of this invention.

A description will hereinafter be given on a principle of this invention with reference to FIG. 11 and so on. FIG. 11 shows a theoretical construction of a pole piece of this invention in which the configuration of pole piece 3 is changed to have a dimension a instead of the point construction of FIG. 2. If the vibrating amplitude of reed 2 is taken as A, the length a of pole 3 is selected so as to satisfy the following relation:

$$0<a<A \tag{3}$$

In FIG. 11, when the vibratory reed 2 is knocked by a hammer to make a free vibration with frequency f, a voltage is induced in the winding 8 during a period from $t_o$ (at the maximum amplitude of one side) to $t_1$ (at the outer tip of pole piece 3), which is expressed as follows:

$$e_{t_o-t_1} = \frac{(A\cos 2\pi ft - a)\sin 2\pi ft}{[l^2 + (A\cos 2\pi ft - a)^2]^2} \tag{4}$$

During a period from $t_1$ to $t_2$ (at zero amplitude or neutral position), magnetic flux is not changed so that no voltage is induced, that is, $e_{t_1-t_2}=0$. During a period from $t_2$ to $t_3$ (at the maximum amplitude of the other side), a voltage shown by the following equation (5) is induced in the winding 8:

$$e_{t_2-t_3} = \frac{A\cos 2\pi ft \cdot \sin 2\pi ft}{[l^2 + (A\cos 2\pi ft)^2]^2} \tag{5}$$

The above described vibration corresponds to half period so that the same variation is repeated to the reverse side to form one period. The voltage waveform in this case is shown in FIG. 12.

Figure 12:
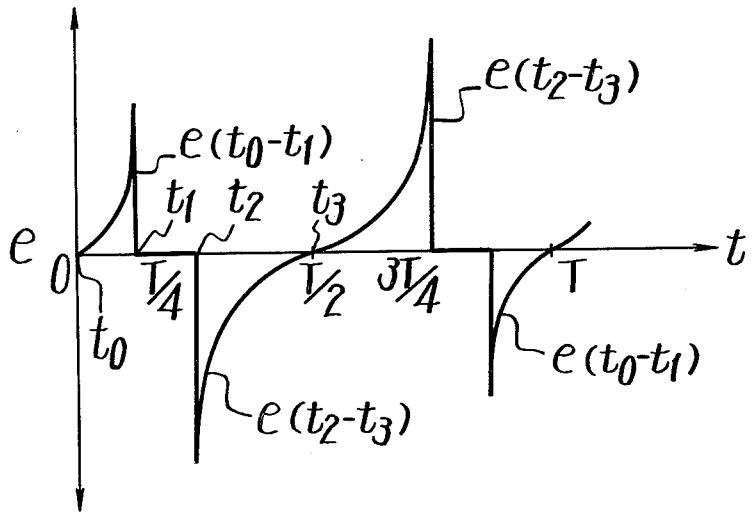
FIG. 12 is a waveform showing a signal voltage obtained by the pickup of the invention shown in FIG. 11.
Figure 13:
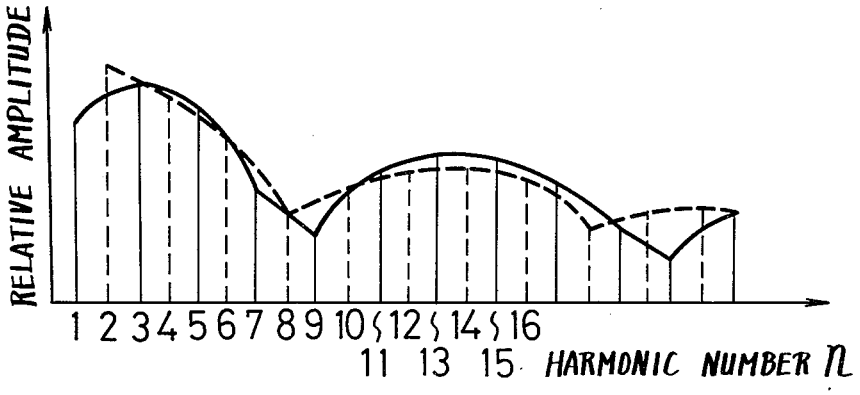
FIG. 13 is a graph showing a spectral distribution of the signal voltage shown in FIG. 12.

In FIG. 12, the following relations are taken: $t_o=0$, $t_1=(T/2\pi)\cos^{-1}(a/A)$, $t_2=T/4$, and $t_3=T/2$, and a symmetry with T/2 as a center or odd function waveform is obtained. A spectral distribution of this voltage waveform is shown in FIG. 13.

In this case, the length a of the pole piece 3 is selected within a range shown in equation (3) thereby to eliminate the level difference between even and odd harmonics. Further, it is possible to represent a complicated uneven distribution as compared with those in FIGS. 4 and 7. These amplitudes of harmonics are calculated from a Fourier series $b_n$ shown in the following equation (6), because of the odd function waveform.

$$|b_n| = \frac{4}{T}\left|\int_0^{T/2} e(t)\cdot\sin(n\cdot 2\pi ft)dt\right| \quad (6)$$

Figure 4A:
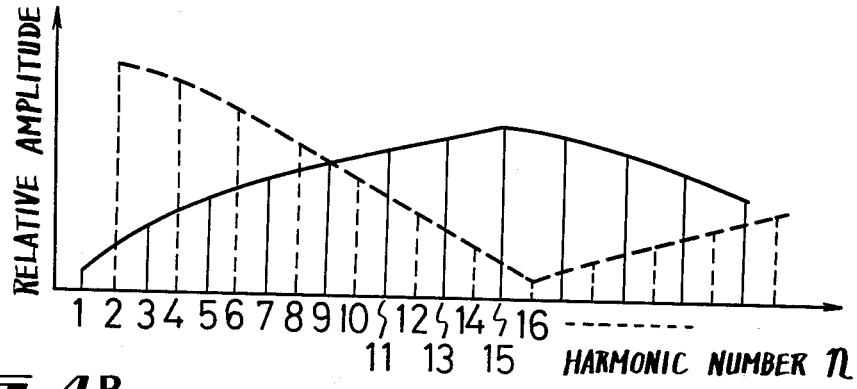
Figure 4B:
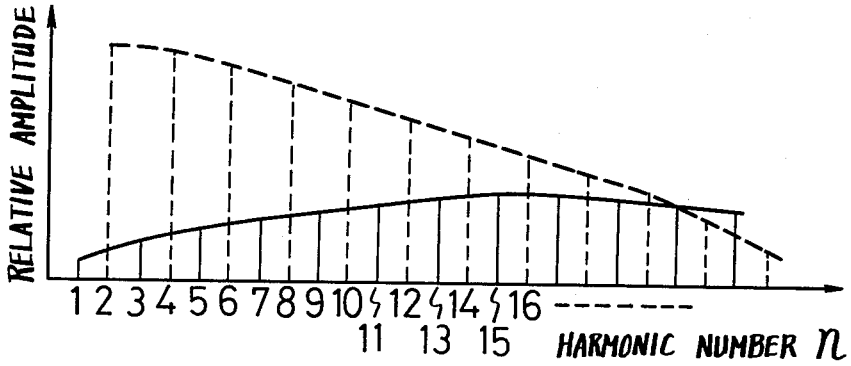
Figure 4C:
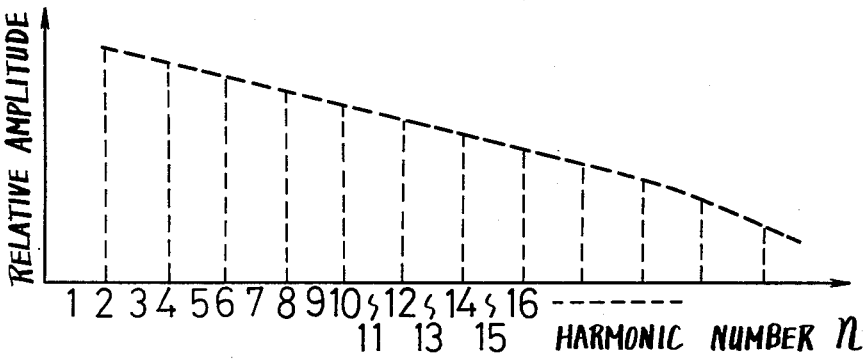
Figure 5:
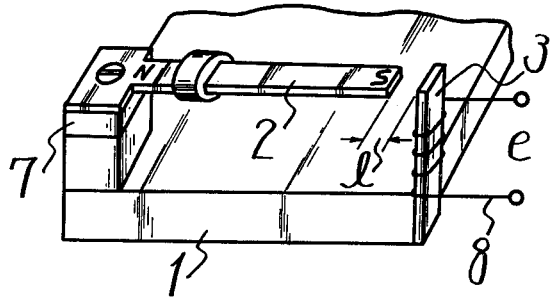
PRIOR ART Fig. 5
FIG. 5 is a perspective view showing a second example of the prior art pickup devices.

With the spectral distributions shown in FIGS. 4A to 4C, the integral interval of equation (6) is divided into $(0-T_o)$ and $(T_o-T/2)$ so that the following equation (7) is obtained:

$$|b_n| = \frac{4}{T}\left|\int_0^{T_o} e(t)\sin(n\cdot 2\pi ft)dt + \int_{T_o}^{T/2} e(t)\sin(n\cdot 2\pi ft)dt\right| \quad (7)$$

Figure 3:
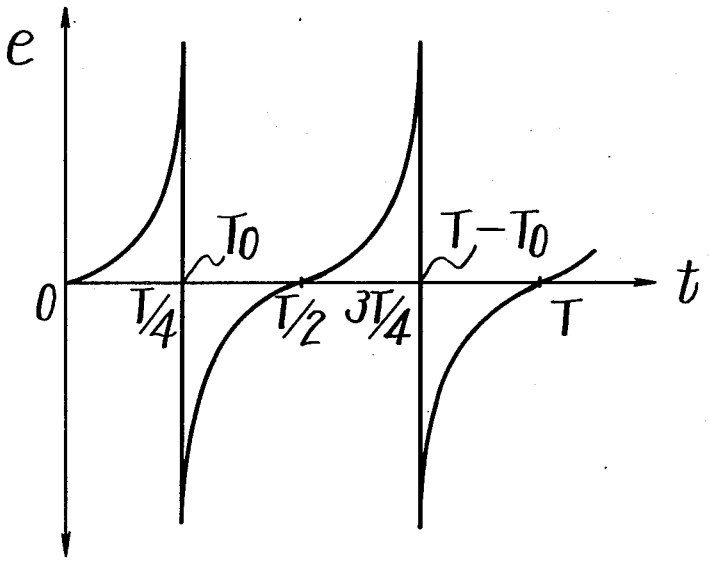
FIG. 3 is a waveform showing a signal voltage obtained from the pickup of FIG. 1, FIGS. 4A, 4B and 4C are graphs showing spectral distributions of a signal voltage shown in FIG. 3.

It is noticed from FIG. 3 that a voltage e(t) is substantially symmetrical and reverse in waveform during periods $O-T_o$ and $T_o-T/2$. Accordingly, when n is, for example, 1 (fundamental tone component), the first term and second term in equation (7) are reversed in polarity and substantially the same in value, so that $|b_1|$ at $n=1$ is quite small. When $n=2$, the first term and the second term are the same in polarity and substantially the same in value, so that $|b_2|$ provides the maximum amplitude level, and so forth. Thus, the spectral distributions as shown in FIGS. 4A to 4C can be obtained.

In the prior art spectral distribution shown in FIG. 7, the integral interval is $T/4-T/2$, so that equation (6) is rewritten as follows:

$$|b_n| = \frac{4}{T}\left|\int_{T/4}^{T/2} e(t)\sin(n\cdot 2\pi ft)dt\right| \quad (8)$$

Figure 6:
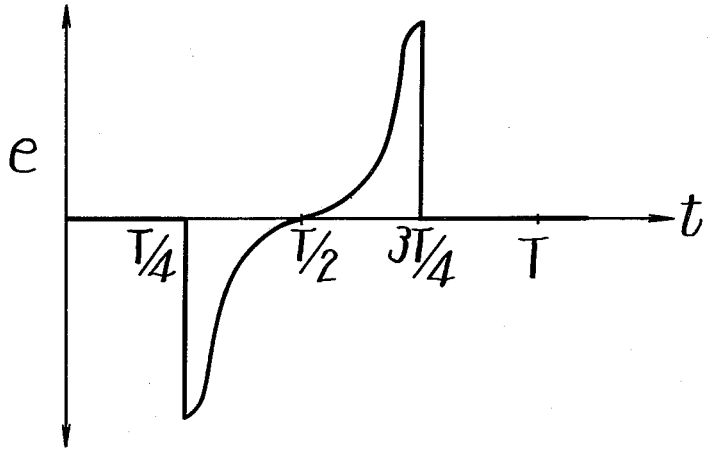
FIG. 6 is a waveform showing a signal voltage obtained by the pickup of FIG. 5.

In this case, the output voltage has the waveform shown in FIG. 6 so that the integral value is the maximum at $n=1$ but becomes small at $n=2$. Thus, the distribution as shown in FIG. 7 can be obtained.

Meanwhile, in this invention the equation (6) can divide the integral interval as shown in the following equation (9).

$$|b_n| = \frac{4}{T}\left|\int_0^{t_1} e_{t_o-t_1}(t)\sin(n\cdot 2\pi ft)dt + \int_{t_2=\frac{T}{4}}^{t_3=\frac{T}{2}} e_{t_2-t_3}(t)\sin(n\cdot 2\pi ft)dt\right| \quad (9)$$

In this case, the output voltage $e_{t_o-t_1}(t)$ is given by equation (4) and $e_{t_2-t_3}(t)$ by equation (5), and $t_1$ is given by $(T/2\pi)\cos^{-1}(a/A)$. The second term of equation (9) is equal to equation (8), but the spectral distribution of FIG. 7 is changed to that of FIG. 13 according to the integral value of the first term thereof. The integral value of the first term can be varied by selecting the integral region $t_1$ or the magnetic pole length a in a range of equation (3). As a result, the spectral distribution can be changed in the range from the state of FIG. 4 to that of FIG. 7 thereby to exhibit characteristics such that the level difference between odd and even harmonic components is eliminated and the whole envelope is uneven as shown in FIG. 13.

The above spectral distribution which can be varied from FIG. 4 to FIG. 7 will be described with a ratio a/A being changed.

Figure 18A:
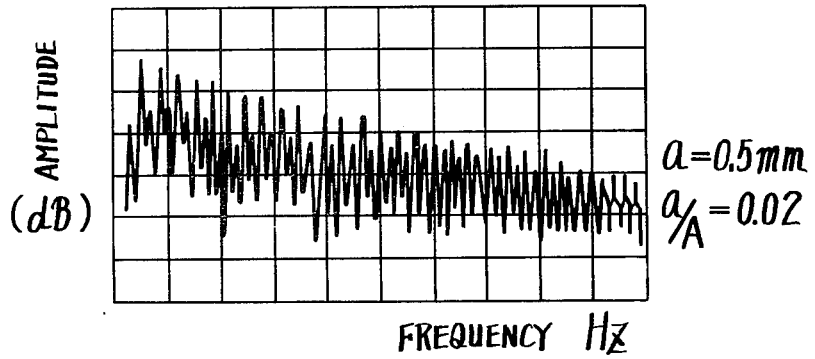
Figure 18B:
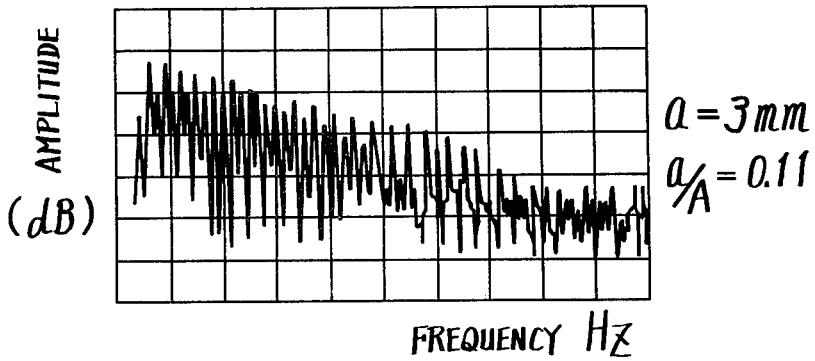
Figure 18C:
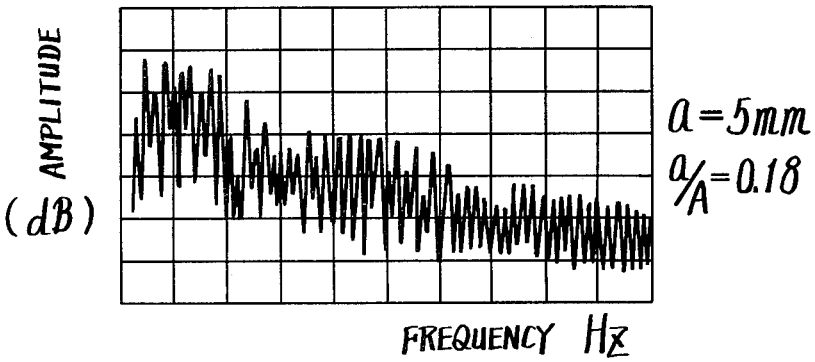
Figure 18D:
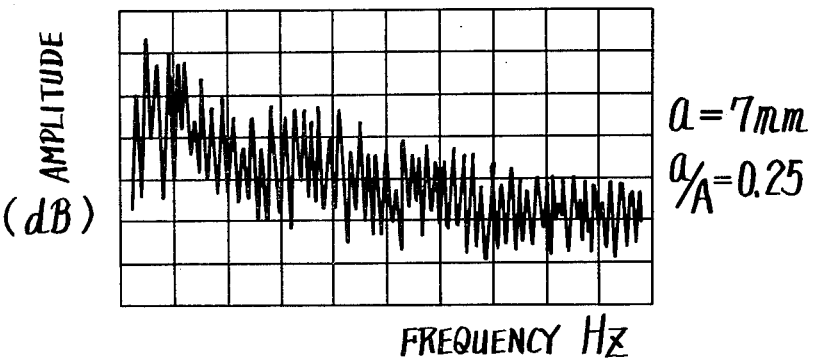
Figure 18E:
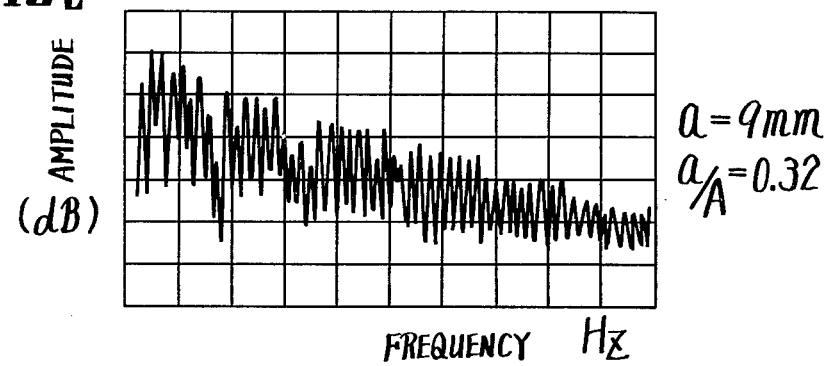
Figure 18F:
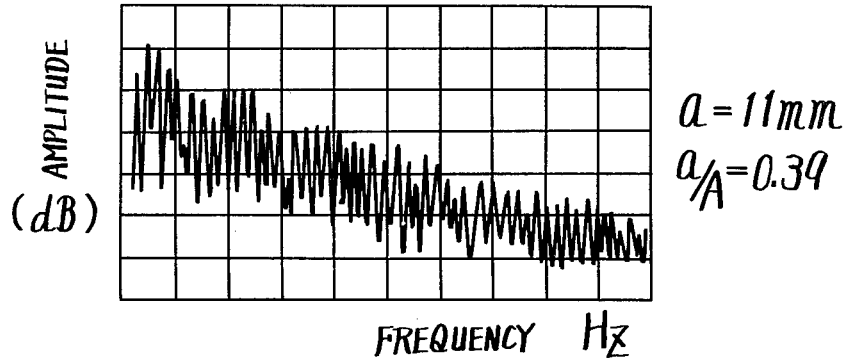
Figure 18G:
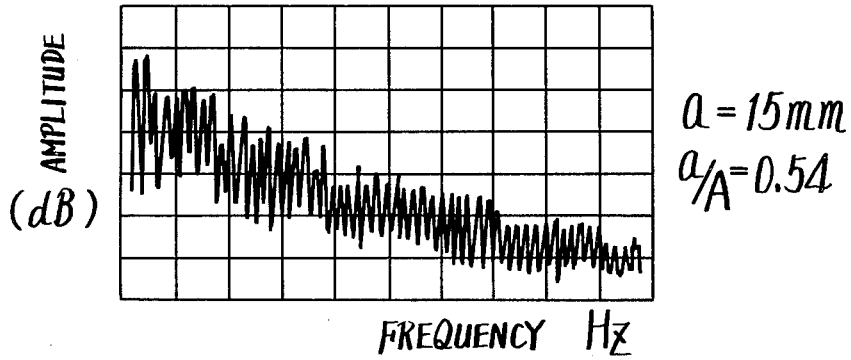
Figure 18H:
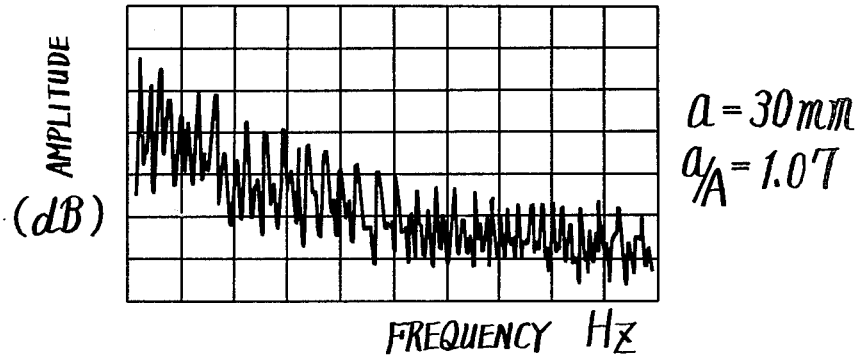

FIGS. 18A to 18H, inclusive, are measured results of spectral distribution when the pole length a is changed with respect to vibrating amplitude A, in which abscissa represents frequency, each scale corresponding to 250 $H_z$, and ordinate represents relative amplitude level of harmonic components, each scale corresponding to 10 db, respectively. In these measured results, key number 1 or fundamental vibrating frequency is 43.65 $H_z$ and the amplitude of the reed at one side is 28 mm. For example, FIG. 18A is a measured result when the pole length a is 0.5 mm and a/A is 0.02, in which the first amplitude at the left side is of the fundamental tone having frequency 43.65 $H_z$, and the relative amplitude levels of higher harmonics are shown rightwards such as harmonic number 2 at 87.30 $H_z$, 3 at 130.95 $H_z$ . . . , respectively. FIG. 18B is of a case where a is 3 mm and a/A is 0.11, and similarly FIG. 18C to FIG. 18G, inclusive, are of cases where a=5 mm, 7 mm, 9 mm, 11 mm, 15 mm and a/A=0.18, 0.25, 0.32, 0.39, 0.54, respectively. FIG. 18H is a measured result at a time when a is 30 mm and a/A is 1.07, that is, when the pole length is greater than vibrating amplitude (corresponding to FIG. 7 or FIG. 8). The spectrum of FIG. 18A substantially corresponds to the case of deviation b=0 according to the prior art pole arrangement (corresponding to FIG. 1), and its spectrum envelope is formed of even-numbered components of harmonic numbers 2, 4, 6 . . . with odd-numbered components of harmonic numbers 1, 3, 5 . . . being decreased or lacked. As the pole length a is increased, even harmonics and odd harmonics are unevenly produced as shown in FIGS. 18B and 18C. Meanwhile, as shown in FIG. 18D where a=7 mm and a/A=0.25, in FIG. 18E where a=9 mm and a/A=0.32, and in FIG. 18F where a=11 mm and a/A=0.39, the level difference between odd and even harmonics is relatively small in a range of pole length a from 7 mm to 11 mm, and there is some range wherein the spectral distributions of even and odd harmonics have the same shape (envelope). Contrarily, when the pole length a is further increased as shown in FIGS. 18G and 18H, even harmonics become smaller than odd harmonics resulting in a simple spectrum envelope.

Figure 7:
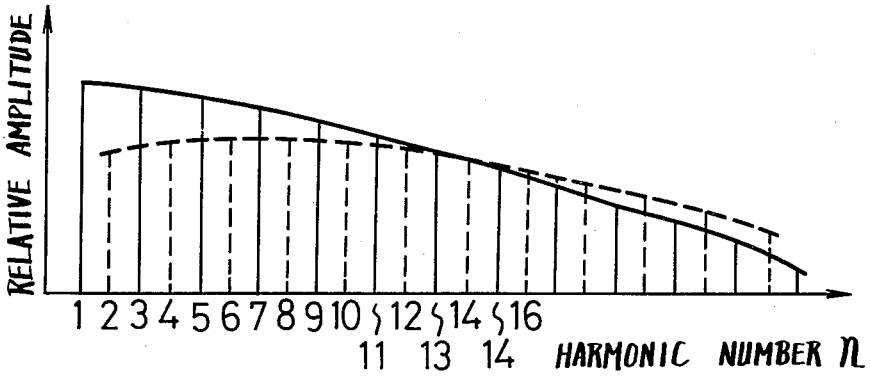
FIG. 7 is a graph showing a spectral diagram of the signal voltage shown in FIG. 6.
Figure 8:
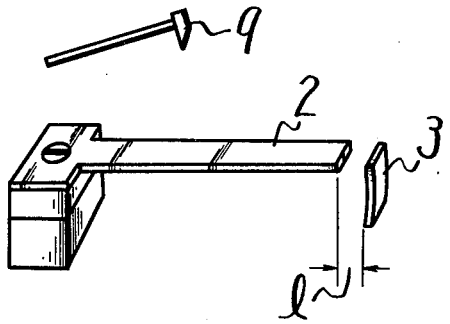
Fig. 8 PRIOR ART
FIG. 8 is a perspective view showing a third example of the prior art pickup devices.
Figure 9:
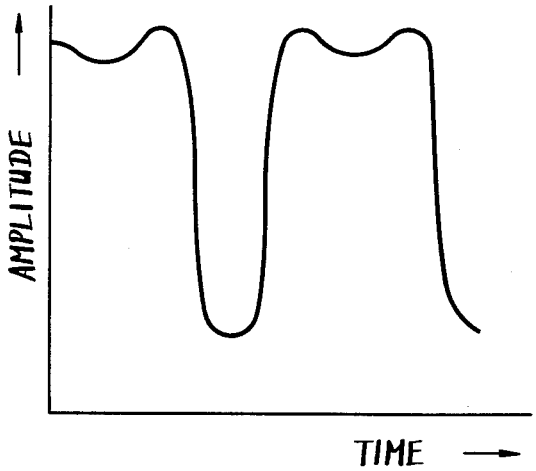
FIG. 9 is a waveform showing a signal voltage obtained by the pickup of FIG. 8.
Figure 10:
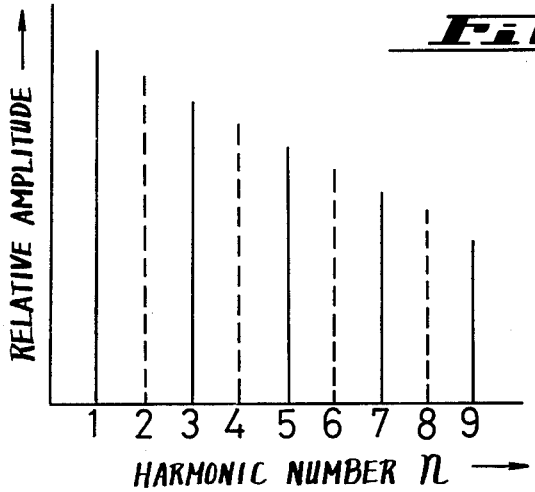
FIG. 10 is a graph showing a spectral distribution of the signal voltage shown in FIG. 9.

As described above, the selection of ratio a/A in the range from 0.25 to 0.39 allows one to improve uncertainty of sound pitch caused by the relative amplitude level difference between odd and even harmonics (FIGS. 4A to 4C), to amend simplicity of tone resulting from simple envelope of the spectral distribution shown in FIG. 7, and to obtain a spectral distribution for providing good tone.

Figure 1:
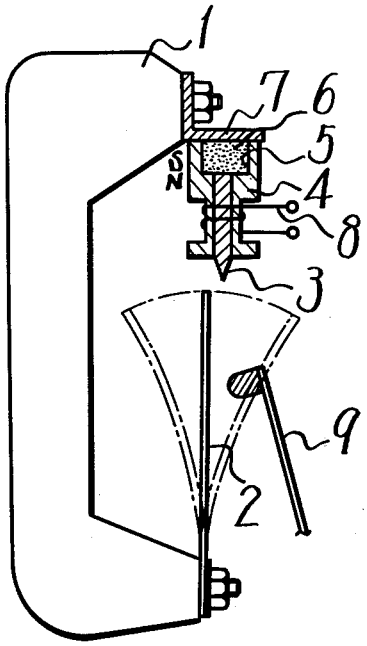
Fig. 1 PRIOR ART
FIG. 1 is a side cross-sectional view showing an example of prior art pickup devices.
Figure 14:
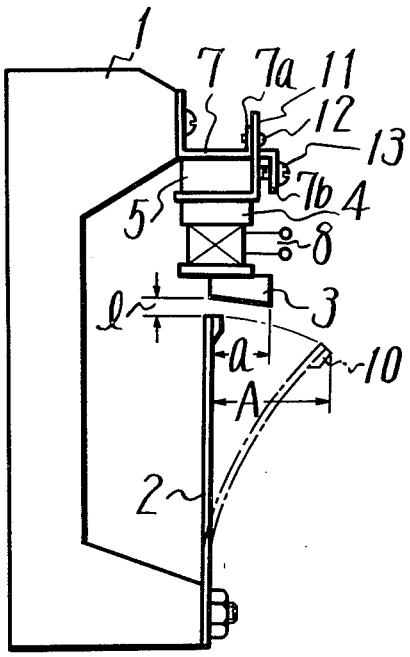
FIG. 14 is a side cross-sectional view showing one embodiment of the pickup device of this invention.
Figure 15:
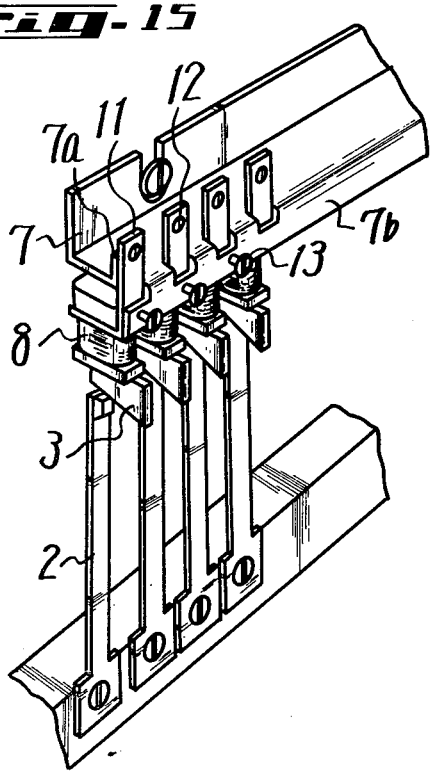
FIG. 15 is a perspective view showing the pickup device of FIG. 14.

A description will next be given on one embodiment of this invention based on the above principle with reference to FIGS. 14 to 16, in which elements corresponding to those in FIG. 1 are shown by the same reference numerals with their description being omitted. FIG. 15 is a perspective view showing reed mounting state of this invention and FIG. 14 is a side view for the above. The vibratory reed 2 has attached at its free end a weight 10 to determine the fundamental frequency f. On each bobbin 4 is disposed an L-shaped metal piece 11 which is attached to an upper projection 7a of the L-shaped metal piece 7 by a screw 12 thereby to vertically adjust the pickup and also to a lower projection 7*b* of the metal piece 7 by a screw 13 thereby to laterally adjust the pickup. The pole piece 3 is held to provide a gap l relative to the vibration of the vibratory reed 2 and the length a of the pole 3 is selected as shown by equation (3). As shown in FIG. 15, there are mounted a plurality of reeds and electromagnetic pickups whose number corresponds to the number of respective keys and the maximum amplitude A of each reed is decreased as the corresponding tone becomes higher. In FIG. 14, the arcuate pole length a of this invention is so selected that it decreases as the maximum amplitude A of reed is decreased so as to keep the value of a/A constant at every key.

Figure 16:
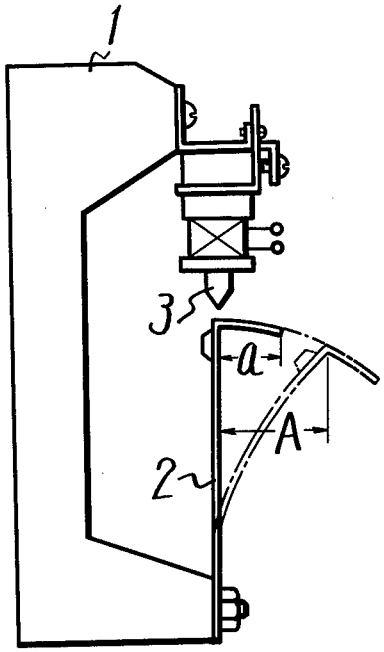
FIG. 16 is a side cross-sectional view showing another embodiment of the pickup device of this invention.

FIG. 16 shows another embodiment of this invention in which the pole piece 3 is of point construction and the free end of the cantilever-type vibratory reed 2 is bend in an arcuate shape. In this embodiment, if the length of this bent portion is taken as a, the gap between reed and pole is kept constant during a time period when the bent portion of the reed is moved with respect to the pole 3 so that no variation is caused in magnetic flux with the result that the same effect as the aforesaid construction can be achieved.

Figure 17:
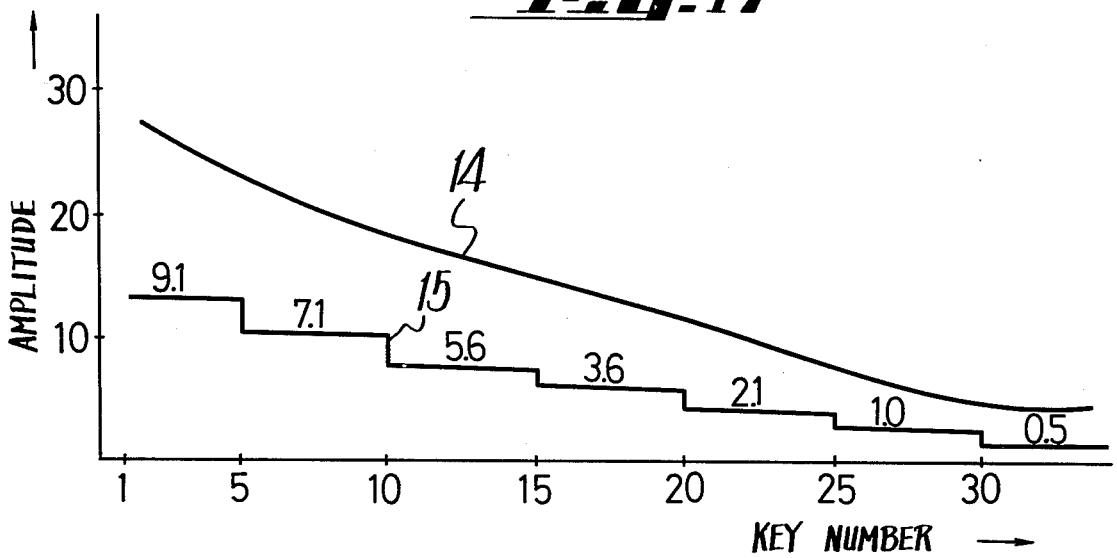
FIG. 17 is a graph showing relationship between the length of a pole piece and the maximum amplitude of a reed with respect to key number, FIGS. 18A to 18H, inclusive, are graphs showing spectral distributions with the dimension a of pole piece being varied with respect to vibrating amplitude A.

With the above-mentioned pickup of this invention, when the reed is knocked by the hammer, its maximum amplitude A is changed according to keyboard action construction, reed knocking position, reed length, reed thickness and the like. In an electronic piano having 75 keys according to this invention, the relation between the maximum amplitude and pole length is shown in FIG. 17, whose abscissa shows key number and whose ordinate shows amplitude. A curve 14 represents the maximum amplitude A of each keyboard, and a stepped curve 15 represents the length a of the pole piece 3 provided at every key.

In the prior art pickup device, the adjustment of spectral distribution is made by laterally shifting the pole piece to change the deviation b at every key for tone control. According to this invention, however, the ratio of a/A is kept constant so that the above adjustment is not necessary and much more uniform or even tone can be produced.

Figure 19A:
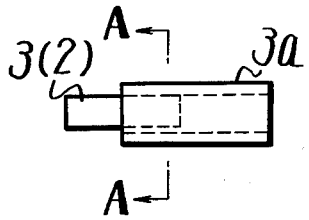
FIGS. 19A and 19B and FIG. 20 are schematic views respectively showing means for varying the dimension of pole piece or reed of this invention.
Figure 19B:
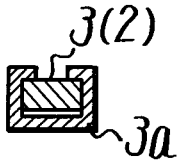
Figure 20:
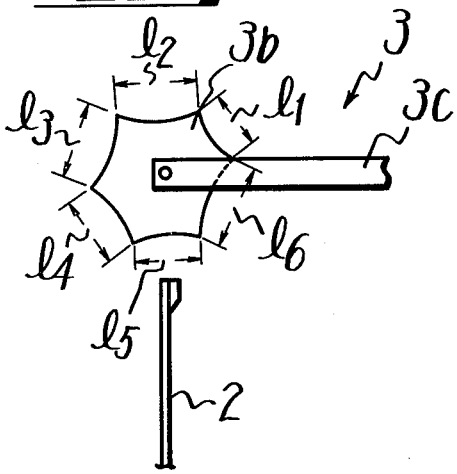

In the above embodiments, the length a of pole piece 3 or reed 2 is predetermined to a certain value at the time of design. As shown in FIGS. 19A and 19B, however, an auxiliary yoke 3*a* longer than pole piece or reed bent portion is slidably incorporated there-through with the pole piece 3 or the bent portion of reed 2 for making pole length variable. FIG. 19B is the cross-sectional view taken along a line A—A of FIG. 19A. In an example of FIG. 20, the pole piece 3 is formed of polygonal member 3*b* and holder 3*c*. The lengths of respective sides $l_1$ to $l_6$, by way of example, of the polygonal member 3*b* are made different from one another. Thus, the polygonal member 3*b* is made rotatable by the holder 3*c* to select its side, for example, $l_5$ as illustrated, to be opposed to the reed 2.

The other variable means can be easily deviced by those skilled in the art and these are included in this invention.

With the invention as described above, the pole length a is properly selected in a range smaller than the vibrating amplitude A thereby to eliminate the level difference between odd and even harmonics to obtain a relatively complicated and uneven spectral distribution. As a result, uncertainty of sound pitch is improved and a tone with good selectivity can be obtained at every musical scale.

It will be apparent that many modifications and variations may be effected without departing from the scope of the novel concepts of this invention.

We claim as our invention:

1. In an electromagnetic pickup device for transducing a mechanical vibration of a vibratory reed into an electric signal, said electromagnetic pickup device comprising, a vibratory reed having a longitudinal axis one end portion of which is fixed to a supporting member and the remaining portion of which is free to vibrate in a predetermined transverse direction, a magnetic means mounted on said supporting member in an alignment relationship to a longitudinal axis of said vibratory reed at a rest position thereof, said magnetic means including a pole piece member, said pole piece member including a surface having an opposing face portion which extends transversely from said rest position to one side of said predetermined transverse direction of a vibration of said reed for a distance such that a substantially constant gap is formed between said reed and said magnetic means so as to maintain constant low magnetic reluctance for a period no longer than one-fourth ($\frac{1}{4}$) cycle of said vibration during vibration from said rest position of said reed, said magnetic means has a magnetizing direction parallel to the longitudinal axis of said reed, and a coil means associated with said magnetic means to generate an electrical signal in response to said vibration of said reed.

2. An electromagnetic pickup device as claimed in claim 1, in which said member is mounted on said magnetic means such that a face of said member is mounted adjacent to said reed.

3. An electromagnetic pickup device as claimed in claim 1, in which said member is mounted on a free end of said reed.

4. An electromagnetic pickup device as claimed in claim 1, in which said member comprises an adjusting means to change said period.

5. An electromagnetic pickup device as claimed in claim 4, in which said adjusting means is a slidable member.

* * * * *